US011365520B2

(12) United States Patent
Sprague

(10) Patent No.: US 11,365,520 B2
(45) **Date of Patent: *Jun. 21, 2022**

(54) BARRIER STAND

(71) Applicant: ABSOLUTE MUSEUM & GALLERY PRODUCTS LIMITED, Sheffield (GB)

(72) Inventor: Samuel Sprague, Lynton (GB)

(73) Assignee: ABSOLUTE MUSEUM & GALLERY PRODUCTS LIMITED, Sheffield (GB)

( * ) Notice: Subject to any disclaimer, the term of this patent is extended or adjusted under 35 U.S.C. 154(b) by 0 days.

This patent is subject to a terminal disclaimer.

(21) Appl. No.: 16/745,088

(22) Filed: Jan. 16, 2020

(65) Prior Publication Data

US 2020/0149234 A1 May 14, 2020

Related U.S. Application Data

(63) Continuation of application No. 16/302,005, filed as application No. PCT/GB2017/000076 on May 16, 2017, now Pat. No. 10,870,957.

(30) Foreign Application Priority Data

May 16, 2016 (GB) ..... 1608561

(51) Int. Cl.
*E01F 13/04* (2006.01)
*E01F 13/02* (2006.01)

(52) U.S. Cl.
CPC ..... *E01F 13/022* (2013.01); *E01F 13/028* (2013.01)

(58) Field of Classification Search
CPC ... E01F 15/06; E01F 15/10; E01F 9/60; E01F 13/02; E01F 13/022; E01F 13/024;
(Continued)

(56) References Cited

U.S. PATENT DOCUMENTS 1,136,746 A 4/1915 White
1,267,116 A 5/1918 Regel
(Continued)

FOREIGN PATENT DOCUMENTS

DE 20202830 U1 7/2002
EP 0303414 A1 2/1989
(Continued)

OTHER PUBLICATIONS

Search Report under Section 17(5) issued in related application No. GB1608561.5, dated Nov. 14, 2016. (4 pages).
(Continued)

*Primary Examiner* — Thomas B Will
*Assistant Examiner* — Katherine J Chu
(74) *Attorney, Agent, or Firm* — Day Pitney LLP; Valeriya Svystun

(57) ABSTRACT

A barrier stand for a barrier comprising a cable is described. The barrier stand has an elongate member and a hollow top section, and at least one slot extending downwardly from the top of the top section, the slot being adapted to receive a cable. A clamping device is located in the hollow section. The clamping device defines a shaft that extends through a bore defined by a guide of the barrier stand. The shaft and guide enable sliding movement of the clamping device towards a clamping position for clamping a cable securely to the barrier stand, and away from the clamping position to release the cable from the barrier stand. The guide is secured to the elongate member thereby maintaining alignment between the clamping device and the elongate member during movement of the clamping device towards and away from the clamping position.

14 Claims, 1 Drawing Sheet

Figure 1:
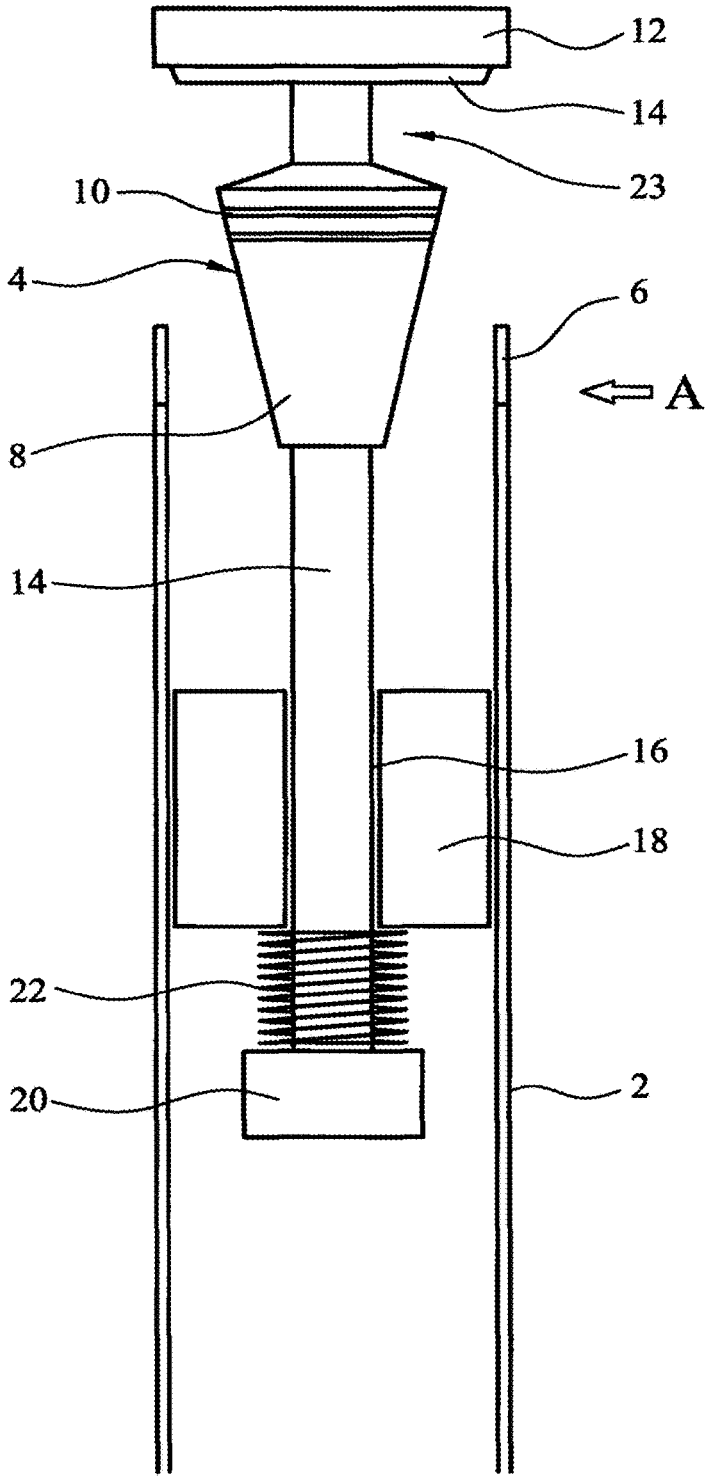

(58) Field of Classification Search
CPC ..... E01F 13/028; E04H 2017/1465; E04H 2017/1469; E04H 17/18; E04H 17/20
USPC ..... 404/6, 9; 49/49; 116/63 C, 63 P, 63 R; 256/13.1
See application file for complete search history.

(56) References Cited

U.S. PATENT DOCUMENTS

| | | | | |
|---|---|---|---|---|
| 1,267,568 | A * | 5/1918 | McAlister | E04H 17/10 256/52 |
| 1,400,455 | A | 12/1921 | Peterson | |
| 1,459,116 | A | 6/1923 | Schmalz | |
| 1,712,752 | A | 5/1929 | Dandliker | |
| 1,792,331 | A | 2/1931 | Sollenberger | |
| 1,828,350 | A | 10/1931 | Williams | |
| 2,042,090 | A | 5/1936 | Cummins | |
| 2,315,516 | A | 4/1943 | Gray | |
| 2,317,248 | A * | 4/1943 | Brickman | E01F 15/025 256/13.1 |
| 2,904,189 | A | 9/1959 | Eisert | |
| 3,194,537 | A | 7/1965 | Gerin | |
| 3,240,475 | A | 3/1966 | Vegh | |
| 3,502,303 | A | 3/1970 | Bishop | |
| 3,782,322 | A * | 1/1974 | Wilson | A63C 19/062 116/63 P |
| 4,944,493 | A * | 7/1990 | Handy | E01F 13/02 256/23 |
| 5,269,251 | A * | 12/1993 | Freeman | E01F 13/02 116/63 C |
| 5,501,429 | A | 3/1996 | Sakuma | |
| 5,755,174 | A | 5/1998 | Freeman | |
| 6,412,230 | B1 | 7/2002 | Zambelli et al. | |
| 6,547,725 | B1 * | 4/2003 | Paolitto | A61B 17/0206 600/201 |
| 7,736,085 | B2 | 6/2010 | Neusch | |
| 8,087,846 | B2 | 1/2012 | Ringelberg | |
| 8,844,907 | B1 | 9/2014 | Davis et al. | |
| 9,347,189 | B2 * | 5/2016 | Eccless | E01F 9/688 |
| 10,011,963 | B2 | 7/2018 | Eaton et al. | |
| 2003/0111657 | A1 | 6/2003 | Green | |
| 2010/0232876 | A1 | 9/2010 | Ringelberg | |
| 2011/0220010 | A1 | 9/2011 | Klein et al. | |
| 2013/0019537 | A1 | 1/2013 | Falcone | |

FOREIGN PATENT DOCUMENTS

| | | | |
|---|---|---|---|
| EP | 0685602 | A1 | 12/1995 |
| GB | 2207942 | A | 2/1989 |
| GB | 2221236 | A1 | 1/1990 |
| GB | 2262120 | A | 6/1993 |
| WO | 2002018707 | A1 | 3/2002 |
| WO | 2005040499 | A1 | 5/2005 |
| WO | 2012037607 | A1 | 3/2012 |

OTHER PUBLICATIONS

Examination Report under Section 18(3) issued in related application No. GB1608561.5, dated Jul. 26, 2018 (5 pages).
Combined Search and Examination Report under Sections 17 & 18(3) issued in corresponding application No. GB1901837.3, dated Feb. 28, 2019. (5 pages).
First Examination Report issued in corresponding application No. EP 17725718.5, dated Oct. 31, 2019. (7 pages).
International Search Report and Written Opinion issued in related application No. PCT/GB2017/000076, dated Aug. 1, 2017.
USPTO Non-Final Office Action issued in corresponding U.S. Appl. No. 16/302,005, filed Aug. 19, 2019.
Search Report under Section 17 issued in related application No. GB 1901837.3, dated Feb. 28, 2019.
USPTO's Non-Final Office Action issued in related U.S. Appl. No. 16/302,005, filed Apr. 24, 2020.

* cited by examiner

BARRIER STAND

This application is a Continuation Application of U.S. application Ser. No. 16/302,005, filed Nov. 15, 2018, which itself is a US National Stage filing of PCT Application Serial No. PCT/GB2017/000076, filed May 16, 2017, which itself claims priority to UK Application Serial No. GB 1608561.5, filed May 16, 2016, the disclosures and teachings of which are incorporated herein by reference.

The present invention relates to a barrier stand for a barrier comprising a cable such as an elasticated cord, and particularly, but not exclusively, a barrier to guide people in a certain path or to protect objects such as paintings, sculptures or precious items to be viewed by the general public by defining a closed area around or in front of the objects from which the general public are excluded.

Such barriers are in general known but can be expensive, awkward and time-consuming to install in locations where only a temporary barrier of a particular length is required, such as in art exhibitions, museums, car showrooms, events and retail environments where the exhibits may be changed from time to time for an exhibition, display or event.

The present invention seeks to provide a barrier stand to which a cable or cables can be quickly and inexpensively attached and to easily adjust the length of the cable between a plurality of barrier stands by employees with little or no expertise or experience.

According to the present invention there is provided a barrier stand for a barrier comprising a cable, the barrier stand comprising an elongate member of generally tubular form and being adapted to be mounted on a base so as to stand in a vertical position, and having a top section, at least one cable locating opening or recess extending downwardly from the top of the top section and being open at its upper end, the or each cable locating opening or recess being adapted to receive a cable, and a clamping device located in the top section and being biased resiliently to a clamping position for clamping a cable securely to the stand, wherein the clamping device has a clamping surface to clamp a cable between the clamping device and the top section.

Preferably, the clamping device is movable manually relative to the elongate member against the bias to enable a cable to be inserted into the top section through the or each cable locating opening or recess.

In a preferred embodiment, the clamping surface is defined by a frusto-conical section. Preferably, the clamping device has a cap adapted to close the upper end of the top section of the barrier stand when the clamping device is in the clamping position and in this arrangement may include a guide secured in the upright member to guide the cap into position to close the open end of the top section when the clamping device is lowered into the clamping position by the resilient bias.

Preferably, the clamping device includes a shaft extending from the frusto-conical section through said guide, the shaft having a spring mounting flange on the side of the guide remote from the frusto-conical section, a spring being located between the flange and the guide to bias the clamping device to the closed position.

In a preferred form, the barrier stand has a plurality of said cable locating openings or recesses disposed about the top section preferably four cable locating openings or recesses disposed equidistantly about the top section.

In a preferred embodiment, each cable locating opening or recess is between 3-5 mm in width and 5-10 mm in length and is adapted to support an elastic cable. In this embodiment, the cable is preferably an elastic cable having a diameter 1-1.5 mm larger than the width of the cable locating opening or recess. Preferably the cable locating opening or recess is 4 mm in width and the elastic cable is 5 mm in diameter.

Figure 2:
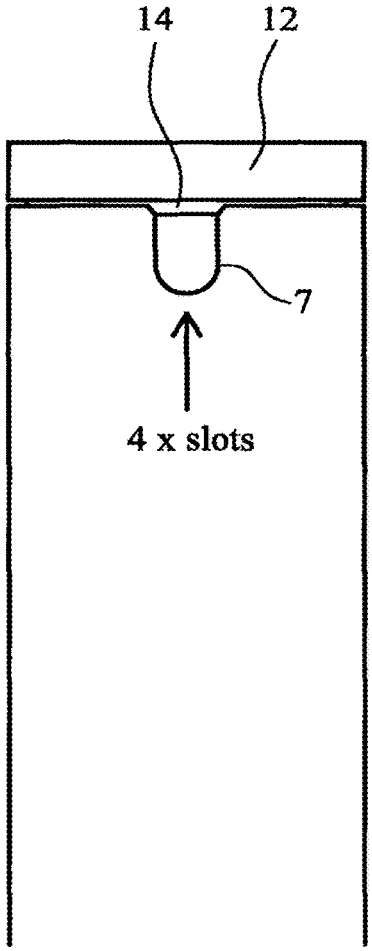

A preferred embodiment of the present invention will now be described by way of example with reference to the accompanying schematic drawing, in which FIG. 1 shows a schematic cross-sectional view through the barrier stand, and FIG. 2 shows a side view of the barrier stand in the direction of the arrow A.

Referring now to FIG. 1 in particular, there is shown a sectional view of a barrier stand consisting of cylindrical tubular upright member 2 which contains a clamping device 4 formed, in this embodiment, predominantly of stainless steel. In other embodiments, the device may be formed of other materials, such as moulded plastics. At its lower end, not shown, the upright member 2 is adapted to be secured on a mounting base to locate the upright member firmly in the vertical position. At its upper open end, in this embodiment, the upright member has four equidistantly spaced slots 6, spaced about the periphery of the open end. Each slot is open at its outer end and is between 3-5 mm in width and approximately 5-10 mm in length. At the lower end each slot 6 terminates in an arcuate curve 7, as shown in FIG. 2. In other embodiments, a different number of slots may be provided.

The clamping device comprises a frusto-conical section 8 which forms a clamping surface and to improve the clamping properties may have a roughened surface, which in this embodiment is in the form, as shown, of a plurality of concentric ridges 10. The angle of the conical part is typically a maximum of 10 degrees but may be as low as 2 degrees. The larger diameter part of the frusto-conical section is at the upper end of the clamping device and tapers inwardly to a shaft 14 extending downwardly. The clamping member 4 has a cap 12 having a diameter the same as that of the upright member 2 and has on its underside a section of reduced diameter 14 which serves to locate the cap accurately in position on top of the upright member 2 to give a smooth neat snag-free finish.

The shaft 14 extends with a close sliding fit through a bore 16 in a guide 18 secured to the upright member 2 which also serves to ensure that the cap 12 is maintained closely aligned with the upright member 2. The bore 16 is approximately 25 mm long. At its end remote from the frusto-conical section 8, the shaft has a spring mounting flange 20 which serves as a mounting for a coil spring 22 located between the flange 20 and the guide 18 to thereby resiliently bias the shaft 14 and hence the clamping device downwardly to a clamping position. The maximum lift of the cap is in the region of 15-20 mm.

In operation, this embodiment is intended for use with an elastic cable of 5 mm diameter and the slots are designed to be 4 mm in width. To secure the cable to the stand, the clamping device 4 is lifted upwardly against the resilient bias and the end of the cable (not shown) is inserted into the gap between the top edge of the tubular member 2 and the frusto-conical surface so that the free end of the cable extends downwardly into the tubular member 2 and is compressed to be pushed down into the slot 6. The clamping device is then released and the end of the cable within the tubular member 2 is clamped between the inner surface of the tubular member 2 adjacent to the slot 6 and the clamping surface 8 of the frusto-conical section. The cable is then stretched from the barrier stand to either another barrier stand in a long barrier or to a fixed mounting point, on a wall for example.

It is envisaged that a long cable can be attached to a plurality of the stands by pressing the cable onto one slot 6 and then passing the remainder of the cable over the top of the frusto-conical section 8 so that it sits within the recess 23 when the cap is depressed and out of the stand through another slot 6 where it is also secured by being compressed into the slot. Thus, the one long cable can be secured to a plurality of the barrier stands to form a particular configuration of barrier with changes of direction through 90° or straight on when four slots are provided. Although described with reference to the use of an elastic cable, it will be understood that the barrier stand can also be used with essentially non-elastic cable providing the size of the slot is appropriate for the cable being used.

Moreover, it should be clear to the skilled person that the slot described above could be an opening, a recess, a roughened surface or any other suitable cable locating means.

The invention claimed is:

1. A barrier stand for a barrier comprising a cable, the barrier stand comprising:

an elongate member of substantially tubular form, the elongate member being adapted to be mounted on a base so as to stand in a vertical position, the elongate member having a hollow top section open at an upper end, the elongate member defining at least one slot extending downwardly from a top of the hollow top section, the at least one slot being adapted to receive a cable;

a guide defining a bore; and a clamping device located in the hollow top section, the clamping device defining a shaft, the shaft maintaining a close sliding fit with the bore, and the shaft extending through the bore to enable sliding movement of the clamping device relative to the guide, towards a clamping position for clamping a cable securely to the barrier stand, and away from the clamping position to release the cable from the barrier stand;

wherein the guide is secured to the elongate member thereby maintaining alignment between the clamping device and the elongate member during sliding movement of the clamping device towards and away from the clamping position.

2. A barrier stand according to claim 1, wherein the clamping device defines a clamping surface arranged to clamp a cable between the clamping surface and said top section of the elongate member when the clamping device is in the clamping position.

3. A barrier stand according to claim 2, wherein a section of the clamping device that defines the clamping surface is larger towards an upper end of the clamping device than a lower end of the clamping device so that movement of the clamping device downwardly towards the clamping position narrows the gap between the clamping surface and said top section of the elongate member, thereby clamping a cable therebetween.

4. A barrier stand according to claim 3, wherein the section of the clamping device that defines the clamping surface comprises a plurality of concentric ridges.

5. A barrier stand according to claim 3, wherein the section of the clamping device that defines the clamping surface comprises a frusto-conical section that has a diameter that is larger toward the upper end than the lower end of the clamping device, and tapers inwardly towards the lower end of the clamping device.

6. A barrier stand according to claim 1, further comprising a cable, wherein the cable is an elastic cable of 1-1.5 mm diameter larger than a width of the at least one slot.

7. A barrier stand according to claim 1, wherein the clamping device has a cap adapted to close the upper end of the hollow top section of the elongate member when the clamping device is in the clamping position, the shaft and the guide maintaining the cap in close alignment with the elongate member during movement of the clamping device towards and away from the clamping position.

8. A barrier stand according to claim 7, wherein the cap is connected to the shaft via a section of the clamping device that defines a clamping surface.

9. A barrier stand of claim 1, wherein the clamping device is biased resiliently relative to the clamping position and movable manually relative to the elongate member against the bias to enable a cable to be clamped or inserted into the top section through said slot.

10. A barrier stand according to claim 1, having a plurality of said slots disposed about the top section.

11. A barrier stand according to claim 10, including four slots disposed equidistantly about the top section.

12. A barrier stand according to claim 1, wherein the or each slot is between 3-5 mm in width and 5-10 mm in length.

13. A barrier including two or more spaced barrier stands in accordance with claim 1, joined together by at least one cable.

14. A barrier according to claim 13, wherein the elongate member of each barrier stand defines a plurality of slots at a top of the top section, the slots each being adapted to receive the at least one cable.

* * * * *